United States Patent [19]

Rowe, Jr.

[11] 4,425,949

[45] Jan. 17, 1984

[54] PROCESS FOR REMOVING UNDESIRABLE SUBSTANCES FROM ELECTRICAL DEVICES

[75] Inventor: Edward A. Rowe, Jr., North Perry, Ohio

[73] Assignee: Diamond Shamrock Corporation, Dallas, Tex.

[21] Appl. No.: 344,560

[22] Filed: Feb. 1, 1982

Related U.S. Application Data

[63] Continuation-in-part of Ser. No. 231,137, Feb. 3, 1981, abandoned.

[51] Int. Cl.[3] ..... B65B 3/04

[52] U.S. Cl. ..... 141/1; 141/48; 141/59; 141/63; 141/92; 134/11; 134/12; 134/21; 134/22.1; 134/31; 134/37

[58] Field of Search ..... 427/116, 58, 294, 295, 427/345, 121, 296, 297, 326; 252/567, 570, 571; 29/402.18, 592 R; 174/14 R, 17 R, 17 LF, 17 LG; 134/11, 12, 21, 22 R, 31, 37, 22.1; 141/1, 48, 59, 63, 92

[56] References Cited

U.S. PATENT DOCUMENTS

| | | | |
|---|---|---|---|
| 1,866,346 | 7/1932 | Clark | 427/326 |
| 1,931,373 | 10/1933 | Clark | 361/317 |
| 1,953,216 | 4/1934 | Elsey | 361/327 |
| 1,966,901 | 7/1934 | McMahon | 337/277 |
| 2,019,338 | 10/1935 | Clark | 361/317 |
| 2,139,948 | 12/1938 | Ford et al. | 252/1 |
| 3,485,659 | 12/1969 | Morris | 427/435 |
| 3,733,218 | 5/1973 | Begun | 134/11 |
| 3,957,531 | 5/1976 | Tipping | 134/11 |
| 4,054,036 | 10/1977 | Murphy et al. | 252/571 |
| 4,177,156 | 12/1979 | Jay et al. | 252/66 |
| 4,276,530 | 6/1981 | Benke et al. | 174/14 R |

FOREIGN PATENT DOCUMENTS

| | | | |
|---|---|---|---|
| 358872 | 10/1931 | United Kingdom | 427/326 |

OTHER PUBLICATIONS

Olmsted, "Transformer Askarel Removal to an EPA Clean Level," Conf. Rec. of IAS Annual Meeting, Sep. 30–Oct. 5, 1979, pp. 1053–1055.

Parrish et al., "An Update on the Use, Labeling, Handling and Disposal of PCBS," Conf. Rec. of Annual Pulp Pap. Ind. Tech. Conf., May 5–8, 1981, pp. 15–24.

Hutzinger et al., "The Chemistry of PCB's," CRC Press, Cleveland, Ohio, 1974, pp. 7–8 and 14.

Kirk–Othmer, Encyclopedia of Chemical Technology, John Wiley & Sons, N.Y., vol. 5, pp. 754–755, 760–761, 844–847 and vol. 15, pp. 296–299.

*Primary Examiner*—Norman Morgenstern
*Assistant Examiner*—Richard Bueker
*Attorney, Agent, or Firm*—Walter C. Danison, Jr.

[57] ABSTRACT

The removal of undesirable substances such as water, PCB's and air from the internal components of electrical devices such as transformers and power capacitors is efficiently and effectively achieved by contacting, in the absence of air, the internal components of these various electrical devices with a heat-stable fluid material. The heat-stable fluid materials are preferably halogenated aliphatic hydrocarbons and most preferably perchloroethylene or FREON 113.

12 Claims, 1 Drawing Figure

PROCESS FOR REMOVING UNDESIRABLE SUBSTANCES FROM ELECTRICAL DEVICES

CROSS-REFERENCE TO RELATED APPLICATION

This application is a continuation-in-part of copending application Ser. No. 231,137, filed on Feb. 3, 1981, now abandoned.

BACKGROUND OF THE INVENTION

1. Field of the Invention

This invention relates to a process for removing undesirable substances, e.g., water, oil and air, entrained within various insulating materials as well as other components of non-operating electrical devices.

More specifically, the present invention relates to removing substances that degrade and otherwise adversely affect the functioning of the components, e.g., transformer cores, of electrical devices, particularly of the "oil-filled" type. The present invention further relates to retrofilling oil-filled electrical devices, particularly transformers.

2. State of the Art

Among the more commonly used commercial and industrial electrical devices are the "oil-filled" type. The oil acts as an insulator and at the same time as a cooling fluid when used in such devices as transformers, power capacitors, various cables, switches, circuit breakers and the like. In the recent past, the liquids which have found the widest use in these various "oil-filled" electrical devices are silicone oils, which have been limited in their use due to their expense, and polychlorinated biphenyls and diphenyls (PCB's). These and similar materials have been disclosed in the art, for example, in U.S. Pat. Nos. 1,931,373; 2,139,948 and 4,177,156. While PCB's and the like have been found to be functionally advantageous, the industry has moved away from using these materials due to their toxicity and environmental impact. Substitute oils such as halogenated aliphatic hydrocarbons are now coming into use replacing PCB's and like materials. Such halogenated aliphatic hydrocarbons are disclosed in U.S. Pat. Nos. 1,953,216 to Elsey; 1,966,901 to McMahon; and 2,019,338 to Clark. Furthermore, various fluorinated and chlorinated aliphatic hydrocarbons have found use in a number of applications for electrical devices. For example, U.S. Pat. No. 3,733,218 discloses azeotropic solvent mixtures of trichloroethylene/isobutanol, perchloroethylene/cyclopentanol, perchloroethylene/ethylene glycol monoethyl ether and perchloroethylene/N-amyl alcohol used to clean rosin-based solder circuit boards. U.S. Pat. No. 3,957,531 teaches similar azeotropic solvent mixtures for cleaning circuit boards by immersion in a tank containing such a solvent mixture. It is disclosed in U.S. Pat. No. 4,054,036 that a constant boiling mixture of 1,1,2-trichlorotrifluoroethane and cis-1,1,2,2-tetrafluorocyclobutane are useful as refrigerants, heat transfer media, gaseous dielectrics and the like. It is also disclosed in U.S. Pat. No. 4,276,530 that a fluorocarbon liquid and perchloroethylene are useful as a water collector for a vapor-cooled electrical apparatus which is hermetically sealed to the atmosphere where the disclosed process is applicable solely for an operating electrical apparatus.

The replacement of PCB's as the oils used in the previously mentioned electrical devices has resulted in either the need for new "oil-filled" electrical devices coming on the market replacing those in existence or the retrofilling of those presently in use. The term "retrofilling," as used herein, is to be understood to mean the removal of the dielectric fluid material contained in an electrical device which generally has been in use, optionally purging the emptied electrical device followed by the refilling of the electrical device with the same or different dielectric fluid material. Problems, however, have been encountered with the installation of these new electrical devices, in particular transformers. During the preparation of transformer cores as well as the internal components of the other mentioned electrical devices, atmospheric water is absorbed by the insulator material which is conventionally kraft paper. Also air is entrapped in the core during the winding procedure. As is readily recognized by one skilled in the art, the presence of even small amounts of water and oxygen will create problems in transformer cores as well as the internal components of capacitors or switches. These substances will degrade the materials of the particular component potentially creating "shorts" which in turn will cause more heat to be generated by the component which further accelerates and aggravates the problem. Furthermore, materials finding use as substitute oils (such as halogenated aliphatic hydrocarbons including perchloroethylene and trichloroethylene), while quite stable in the absence of oxygen and light, will autooxidize quite rapidly when exposed to oxygen particularly in the presence of ultraviolet radiation to degrade to various undesirable corrosive products as acetyl chlorides, carboxylic acids, hydrogen chloride and phosgene. Therefore, it has been quite critical during the installation, refilling or maintenance of the electrical device to insure that substantially all degradative or corrosive substances have been removed from the internal components prior to putting the device into operation. In the past, in the case with transformers, this drying or purging procedure has been accomplished by allowing the transformer core to heat up to relatively high temperatures (250° C. or more) under greatly reduced pressure (1 mmHg). This method, however, is not all that satisfactory since it requires 5 to 6 hours or more and it is obviously energy intensive. Also, this method has not always been as effective as desired since residual atmospheric water and air is reabsorbed by the core material.

To retrofill an electrical device, particularly a transformer which contained PCB's, it is necessary to reduce the PCB concentration level to below 500 ppm and most preferably below 50 ppm. There is no known method which can achieve these PCB levels economically and, thus, it has been necessary to dispose of the electrical device. Disposing of an electrical device can represent a major economic loss particularly when the device is a transformer.

Therefore, there is a need for a method for removing undesirable and degradative substances from the internal components of "oil-filled" electrical devices, particularly transformers which method is relatively fast, economical, less energy intensive and most importantly highly effective in removing substantially all of the undesirable substances while not allowing them to reenter the system.

SUMMARY OF THE INVENTION

In accordance with the present invention, it has been discovered that substantially all the undesirable substances can effectively be removed from the internal components of an oil-filled, non-operating electrical device while overcoming or minimizing the problems of the methods presently in use by contacting, in the absence of air, the internal components of the particular oil-filled electrical device with a heat-stable fluid material which preferably forms an azeotrope with the undesirable substance contained within said internal component.

BRIEF DESCRIPTION OF THE DRAWING

The FIGURE of the drawing is a diagram of a process for drying and removing undesirable substances from a transformer core in accordance with the invention.

DETAILED DESCRIPTION OF THE PREFERRED EMBODIMENTS

Figure 1:
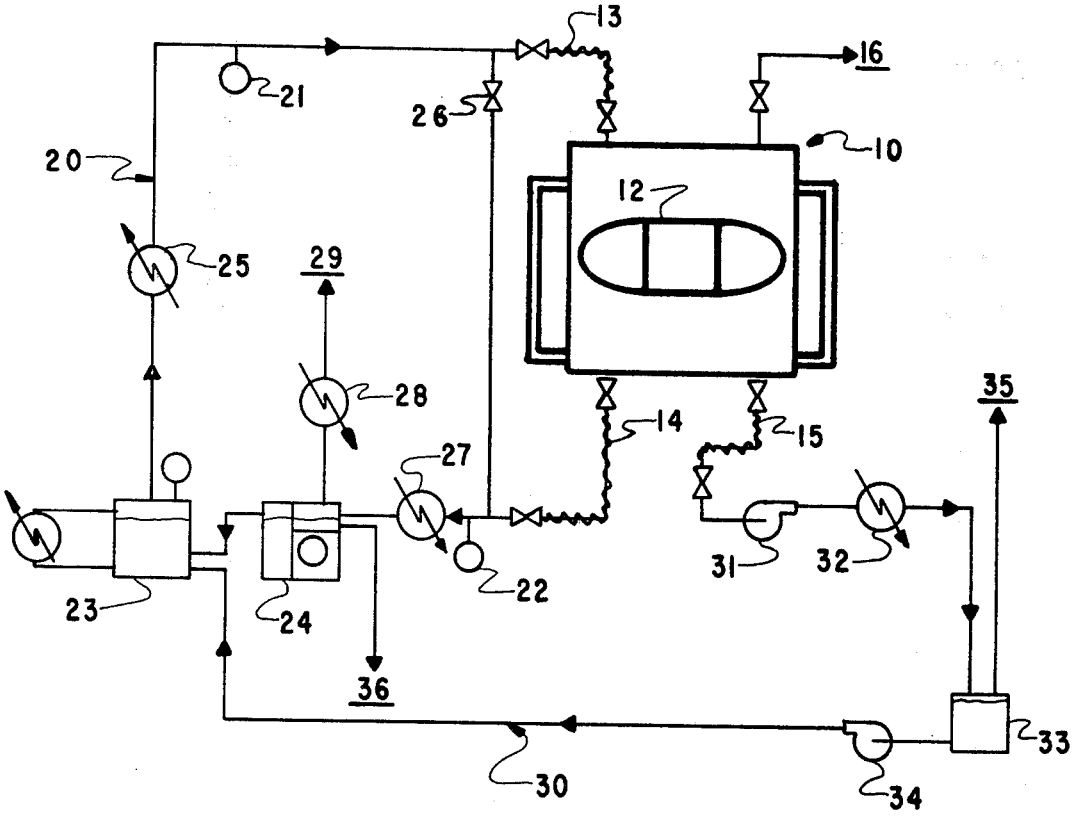

The method of the present invention greatly improves upon the method now in use for drying and removing substances which degrade and affect the functioning of transformer cores. It also provides an effective and economical method for retrofilling transformers which are or have been in use. Clearly, it is necessary to effectively remove substantially all of such undesirable substances during the installation or maintenance of transformer cores. Otherwise, the efficiency of the transformer is greatly reduced as well as the lifetime of the transformer.

It will be readily recognized by one skilled in the art that one of the problems involved with the method presently in use, previously described, is that a partial vacuum is an inefficient heat transfer media. Therefore, while it is highly desirable for the contacting procedure be conducted in the absence of air, the material to which the transformer core is to be contacted should be an effective heat transfer media which requires that the material be heat-stable. It would also be desirable that the material have a relatively high density, i.e., greater than air, as well as being insoluble in water but capable of forming a heterogeneous azeotrope with water. In addition, it should also be recognized that the material preferably be nonflammable, be readily and rapidly absorbed by insulating materials such as kraft paper and the like and compatible with other materials and components of the particular electrical device such as aluminum and copper metals. Such material also will preferably have dielectric properties, low toxicity and be environmentally safe. While the above-listed properties are considered to be desirable and/or preferable, it is pointed out that it is not critical to the present invention that the particular material selected have each and every one of these properties. It should be clear that the selection of the specific material will be dependent upon a variety of factors including the particular electrical device, its function, its parameters, material availability, expense and the like.

While a number of different materials can be employed in the process of the invention, as is evident from the above, it would be desirable to use materials which also may be used as the "oil" to fill the particular electrical device, specifically a transformer. Such materials as halogenated aliphatic hydrocarbons have been found to be particularly useful in the process of the present invention. These halogenated aliphatic hydrocarbons include methylene chloride, carbon tetrachloride, chloroform, trichloroethylene, perchloroethylene, bromochloromethylene, FREON 111, FREON 113 and the like. The most preferred materials being perchloroethylene and FREON 113 (1,1,2-trichloro-1,2,2-trifluoroethane).

One embodiment of the present invention is illustrated in the diagram of the drawing. While the invention is to be further described in connection with the attached drawing diagram, it is intended that the drawing included as a part of this specification be illustrative of a preferred embodiment of the invention and should in no way be considered as a limitation on the scope of the invention. Referring now to the drawing, the diagram illustrates the process for drying and removing undesirable substances, in accordance with the present invention, from transformer core 12 installed in transformer 10. For the purposes of this illustration, the contacting material selected is perchloroethylene which is contained within the reservoir of the thermo siphon reboiler 23. The pressure of the system is first reduced to approximately 1 mmHg by vacuum system 16. The transformer 10 is then closed off to the line of vacuum system 16 and perchloroethylene vapor is introduced to the top of transformer 10 through flexible interconnect 13 and line 20. Perchloroethylene vapor is continuously generated by thermo siphon reboiler 23 from which the vapor is passed into a superheat exchanger 25, if required, prior to its introduction to the top of transformer 10. The perchloroethylene vapor not absorbed and/or condensed by transformer core 12 is passed out of the transformer through flexible interconnect 14 along with removed water, air and other undesirable substances. The outlet vapor temperature is measured at 22. This outlet vapor containing removed substances is passed into a primary condenser 27 and double effect decanter 24. Removed water is taken off through 36 while the inert purge is taken off through inert chiller 28 and purge line 29. The separated perchloroethylene is simultaneously recycled back into the reservoir of reboiler 23. Once the outlet vapor temperature, measured at 22, equals the inlet vapor temperature, measured at 21, transformer 10 has become saturated with perchloroethylene vapor. At this point, the valves of the flexible interconnects 13 and 14 are closed and vapor bypass valve 26 is opened. The valves to flexible interconnect 15 are now opened and the pressure is reduced to approximately 20 mmHg by solvent vacuum system 30 and vacuum pump 31 where perchloroethylene vapor plus residual air and water are passed through inert chiller 32, and the inert purge is removed at 35. Separated and condensed perchloroethylene is then recycled from reservoir 33 by centrifugal pump 34 to the reservoir of reboiler 23. When the pressure of the system reaches approximately 20 mmHg, the system is closed from solvent vacuum system 30. Transformer 10 can then be filled with perchloroethylene or another appropriate "oil" and the pressure equalized with nitrogen.

Optionally, repeated cycles of vapor flushes can be carried out in accordance with the procedures set out hereinabove. Additionally, the above-described vapor flush(es) may be followed by or alternated with hot liquid flush(es). Obviously, the hot liquid flush need not be conducted under reduced pressure where the hot liquid, e.g., perchloroethylene or FREON 113, is pumped through the same system as diagrammed in FIG. 1. The necessity of repeated vapor flushes or the inclusion of hot liquid flushes will be determined by such factors as the substance being removed from the electrical device, the particular electrical device, the size or volume of the electrical device, the particular fluid material used as the flushing medium, the desired degree of decontamination and the like. The process of the present invention has achieved PCB concentration levels down to 10 ppm for retrofilled transformers. Maximum PCB removal was achieved by installing a distillation column between the thermo siphoned reboiler 23 and the super heat exchanger 25. The installation of the distillation column was found effective for the specifical removal of PCB's. However, it is not required for theremoval as such substances as water. A 1500 KVA Uptegraff transformer retrofilled in accordance with the process of the present invention is presently back in service and operating within the expected efficiency range.

The process of the present invention, as described above, may require only 2 hours or less to substantially remove all undesirable substances from the transformer core and does not allow for air to be reintroduced into the transformer or for further exposure to the atmosphere. The advantages of the process of the present invention are clearly seen when compared to the method conventionally used, and previously described, wherein the conventional process requires at least 5 to 6 hours to achieve the desired results, and the core is then temporarily exposed to the atmosphere allowing for the reabsorption of atmospheric moisture. Among the other advantages of the process of the present invention, there may be mentioned that perchloroethylene and the like is clearly a much more efficient heat transfer media than air or a partial vacuum while at the same time the perchloroethylene is rapidly and quite effectively absorbed by the insulating material of the core and thus wicking away impurities such as water from the insulating material as well as not allowing for its reabsorption. Therefore, the process of the present invention requires substantially less energy and time, and at the same time is much more efficient and effective than the conventional method now in use.

The method of the present invention has been illustrated above by removal of undesirable substances from a transformer core. It is not intended for the scope of the present invention to be limited solely to transformers. It will be recognized by those of ordinary skill in the art that the process of the present invention can readily be adapted for use with various electrical devices, particularly the "oil-filled" type previously mentioned, as well as in other technologies. Other features and aspects of this invention will be appreciated by those skilled in the art upon reading and comprehending this disclosure. Such features, aspects and expected variations and modifications of the described method are clearly within the scope of this invention where the invention is limited solely by the scope of the following claims.

What is claimed is:

1. A method for retrofilling a transformer which contains polychlorinated biphenyls and other undesirable substances comprising:

(A) evacuating said transformer to about one millimeter Hg;

(B) introducing a halogenated aliphatic hydrocarbon vapor into said transformer removing that vapor which is not adsorbed or condensed by the transformer, such that PCBs are removed along with said vapor until the outlet vapor temperature equals the inlet vapor temperature;

(C) discontinuing introduction of said halogenated aliphatic hydrocarbon;

(D) evacuating said transformer to about 20 millimeters Hg; and (E) filling said evacuated transformer with a dielectric material.

2. The method according to claim 1 wherein a transformer core is contacted with a halogenated aliphatic hydrocarbon vapor under reduced pressure and said contacting is continued until said transformer is saturated with said aliphatic hydrocarbon vapor at which point said contacting is discontinued and the halogenated aliphatic hydrocarbon vapor containing water and air and other undesirable substances is removed from said transformer under reduced pressure.

3. The method according to claim 1 wherein said halogenated aliphatic hydrocarbon is a chlorinated aliphatic hydrocarbon.

4. The method according to claim 3 wherein said chlorinated aliphatic hydrocarbon is perchloroethylene.

5. The method according to claim 1 wherein said dielectric material is perchloroethylene.

6. The method according to claim 1 wherein said halogenated aliphatic hydrocarbon is 1,1,2-trichloro-1,2,2-trifluoroethane.

7. The method according to claim 1 wherein steps (A)-(C) are repeated for at least one additional cycle.

8. The method according to claim 1 wherein water, air and other undesirable substances are separated from the halogenated aliphatic hydrocarbon vapor removed from said transformer and the separated halogenated aliphatic hydrocarbon is recycled for reuse.

9. The method according to claim 1 wherein the halogenated aliphatic hydrocarbon vapor contacting procedure is followed by at least one hot halogenated aliphatic hydrocarbon liquid flush.

10. The method according to claim 1 wherein the polychlorinated biphenyls concentration level within the transformer core is reduced to less than 50 ppm.

11. The method according to claim 1 wherein the polychlorinated biphenyls concentration level within the transformer core is reduced to less than 10 ppm.

12. A transformer core of a retrofilled transformer wherein the concentration level of polychlorinated biphenyls has been reduced to less than 50 ppm by the process of claim 1.

* * * * *